US011303982B1

(12) United States Patent
White

(10) Patent No.: US 11,303,982 B1
(45) Date of Patent: Apr. 12, 2022

(54) PERFORMANCE ART MICROPHONE SHIELD

(71) Applicant: Sierra N White, Chicago, IL (US)

(72) Inventor: Sierra N White, Chicago, IL (US)

( * ) Notice: Subject to any disclaimer, the term of this patent is extended or adjusted under 35 U.S.C. 154(b) by 0 days.

(21) Appl. No.: 17/069,629

(22) Filed: Oct. 13, 2020

(51) Int. Cl.
*H04R 1/08* (2006.01)

(52) U.S. Cl.
CPC ..... *H04R 1/086* (2013.01)

(58) Field of Classification Search
CPC ..... H04R 1/08; H04R 1/083; H04R 1/086; H04R 19/04; H04R 2410/03; H04R 2420/07
See application file for complete search history.

(56) References Cited

U.S. PATENT DOCUMENTS

| | | | | |
|---|---|---|---|---|
| 4,788,724 | A | 12/1988 | Lazzeroni et al. | |
| 4,944,312 | A | 7/1990 | Smith | |
| 5,440,760 | A * | 8/1995 | Highsmith | A41D 13/1184 2/9 |
| 7,783,069 | B1 * | 8/2010 | Miller | H04R 1/342 381/354 |
| 2002/0166557 | A1 * | 11/2002 | Cooper | H04R 1/083 128/206.28 |
| 2015/0235652 | A1 * | 8/2015 | Moser | G10K 11/002 379/392.01 |

FOREIGN PATENT DOCUMENTS

| | | | |
|---|---|---|---|
| AU | 2015268622 | B2 | 3/2018 |
| CN | 2896944 | Y | 5/2007 |
| CN | 202738863 | U | 2/2013 |
| JP | 2006050542 | A | 2/2006 |
| WO | 2004100690 | A2 | 11/2004 |

OTHER PUBLICATIONS

Name: www.ebay.com Product: Trumpet microphone reflector shield for live sound monitoring, fits Shure 57, 58 Website:https://www.ebay.com/i/224084305468?chn=ps&mkevt=1&mkcid=28 Publication Date: © 1995-2021.

Name: www.mhoxygen.com Product: ALPS Facemasks with or without Microphone Website:https://www.mhoxygen.com/product/alps-facemask/ Publication Date: © Copyright 2021.

Name: www.clearsonic.com Product: FLECTOR Reflective Monitor Disc Website:https://www.clearsonic.com/collections/flector-12/trumpet-shield Publication Date: © 2021.

Name: www.clearsoundbaffles.com Product: The Collar Website:https://www.clearsoundbaffles.com/collections/the-clearsound-collection/products/the-collar Publication Date: © 2021.

* cited by examiner

*Primary Examiner* — Sunita Joshi
(74) *Attorney, Agent, or Firm* — Lamon Patent Services; Cynthia S. Lamon

(57) ABSTRACT

A shield for reducing forward projection of airborne particles ejected from a performer singing into a microphone is provided and includes a material form having an overall length, an overall height, and a uniform material thickness, the material form including at least one through opening and at least one annular microphone collar having an overall length, an overall outside diameter, and an overall inside diameter, the microphone collar affixed to or formed of the material form, the microphone collar accepting a microphone placed therein.

15 Claims, 6 Drawing Sheets

PERFORMANCE ART MICROPHONE SHIELD

CROSS-REFERENCE TO RELATED DOCUMENTS

NA

BACKGROUND OF THE INVENTION

1. Field of the Invention

The present invention is in the field of performance art props and accessories including microphones and pertains particularly to methods and apparatus for shielding a performer operating a microphone from airborne pathogens.

2. Discussion of the State of the Art

In the field performance art, stage performers use microphones particularly if they are singing, speaking, or otherwise performing before a present crowd of people. Performance artists, especially singers, make intimate contact with their crowds and may, at times, leave the stage to get closer to an audience or even mingle with the audience while performing. Typically, a singer will sing into a microphone that may be stationed on a microphone stand on stage and may pick up the microphone and move around the stage including leaving the stage as described above.

In times when a pandemic exists such as SARS or a version thereof where a risk is evident for airborne transmission, masks and strict social distancing rules prevent many performance artists from performing in a manner they are used to. For example, a mask designed to reduce airborne transmission may also muffle the singer's voice and may distract the audience from the singer's persona while the singer is performing. Moreover, the singer may feel restricted and may not have the confidence it requires to perform in an uninhibited or carefree manner that is part of the performance for many. Singing without a mask may require the performer not to leave the stage or approach any members of the audience due to the elevated risk. A critical part of a successful live performance is that the audience members see and connect with the performer's face, facial expressions and an ability to see the singer or performers mouth while forming words is critical to enhance drama with timing concerns as well as to aid those that may be lip readers. Additionally, the performer needs to not have their view impeded so a visual connection with the audience or specific members of the audience is maintained.

Therefore, what is clearly needed is a microphone shield that may enable the singer to reduce forward projection of airborne particles beyond the immediate vicinity of the singer, protecting the audience while maintaining the personal connection between the performer and the audience members.

BRIEF SUMMARY OF THE INVENTION

According to an embodiment of the present invention, a shield for reducing forward projection of airborne particles ejected from a performer singing into a microphone is provided and includes a material form having an overall length, an overall height, and a uniform material thickness, the material form including at least one through opening and an annular microphone collar having an overall length, an overall outside diameter, and an overall inside diameter, the microphone collar affixed to or formed of the material form, the microphone collar accepting a microphone placed therein.

In one embodiment, the material form is a polymer sheet molded to or otherwise formed to a shape presenting a forward shield wall flanked on either side by substantially parallel rearward-extending wing portions. In one embodiment, the microphone collar extends forward and angularly downward from the forward face of the shield, the longitudinal axis of the microphone and the vertical axis of the shield forming an intersect angle larger than ninety degrees. In another embodiment, the microphone collar extends forward and orthogonally from the forward face of the shield, the longitudinal axis of the microphone and the vertical axis of the shield forming an intersect angle of substantially ninety degrees.

In one embodiment, the microphone collar is fabricated of silicon rubber material and is affixed to the material form in the fashion of a grommet. In another embodiment, the microphone collar is materially contiguous with the material form. In one embodiment, the forward face of the shield is shaped on the top edge thereof to reveal the singer's eyes, the bottom edge extending several inches below the singer's mouth.

In one embodiment of the present invention, the microphone collar is a standard microphone clip attached to the material form. In this embodiment, the shield may be mounted to a microphone stand via the microphone clip. In one embodiment, the inside diameter of the microphone collar tapers down from the material form to the free end thereof to match the existing taper of the outside diameter of the seated microphone over a same distance. In one embodiment, the shield material is wholly or partially transparent. In another embodiment, the shield material is painted or marked with one or a combination of symbols, words, logos, or artwork. In a variation of this embodiment, the wing portions are shaped to emulate bird wings or butterfly wings.

In one embodiment where the microphone collar is a grommet attachment, the microphone collar presents at an angle to the forward face of the shield and wherein a singer may change the direction of the angle by turning the microphone collar clockwise or counterclockwise at the grommet interface.

In one embodiment, there are two or more through openings equally spaced apart linearly in the material form to host microphone collars and four or more rearward extending wing portions to flank a like number of singers, and wherein the shield is supported by a row of equally spaced microphones clipped onto a like number of microphone stands.

DETAILED DESCRIPTION OF THE INVENTION

In various embodiments described in enabling detail herein, the inventor provides a unique microphone shield for reducing length and angular transmission of airborne particles resulting from singing. It is a goal of the present invention to provide a lightweight microphone shield that reduces projection of airborne particles from a singer operating the microphone without distracting from the persona of the singer. The present invention is described using the following examples, which may describe more than one relevant embodiment falling within the scope of the invention.

Figure 1:
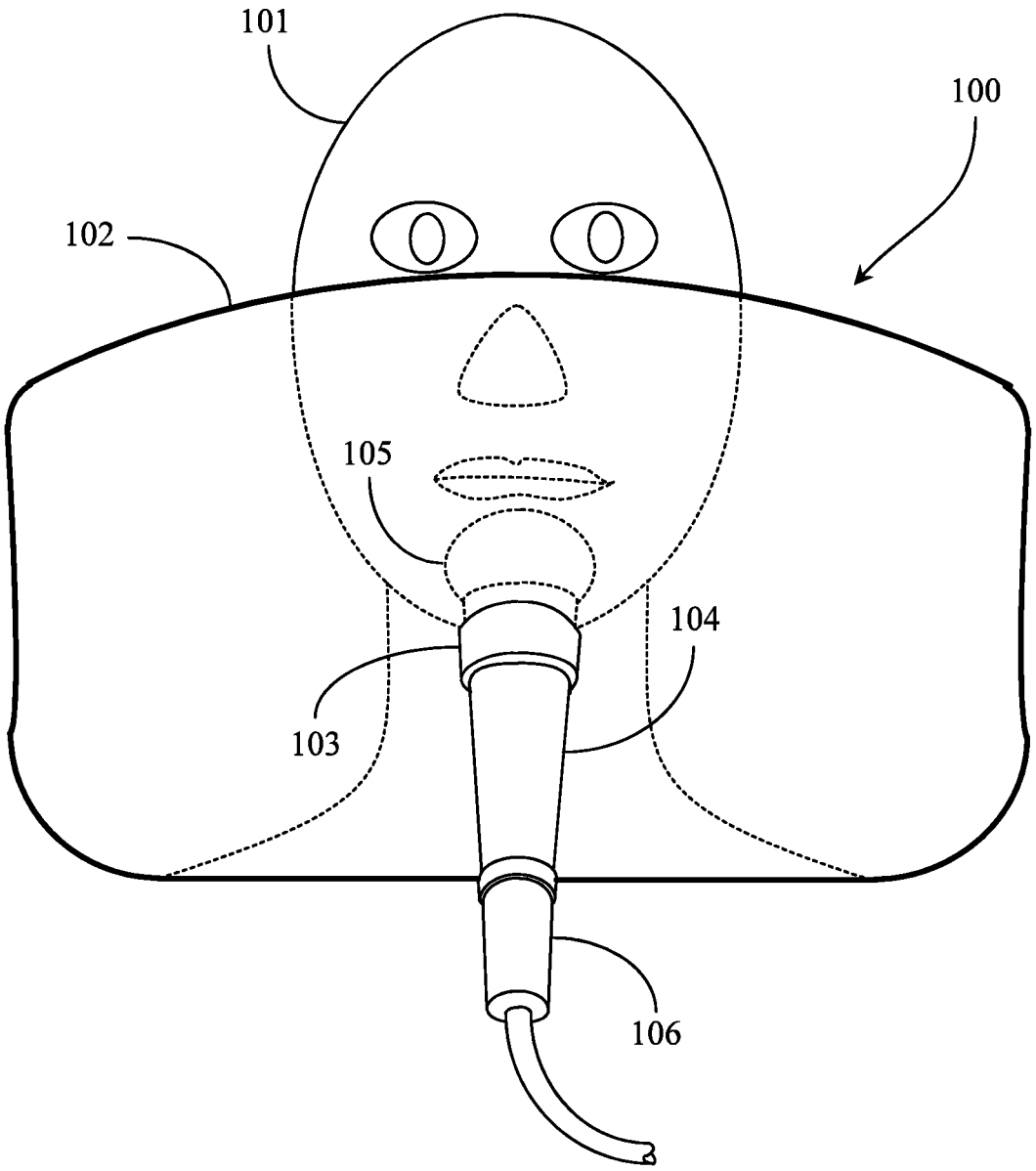
FIG. 1 is a front elevation view of a microphone shield seating a microphone according to an embodiment of the present invention.

FIG. 1 is a front elevation view 100 of a microphone shield seating a microphone according to an embodiment of the present invention. View 100 depicts a microphone shield 102 that is adapted to seat a hand-held microphone 104 through the material of the shield. Shield 102 may be a thin transparent polymer sheet material that may be formed by heating or bending or that may be plastic molded to form a frontal barrier between a singer 101 holding a microphone 104 that is seated through the shield and an audience and/or other singers and musicians on a stage.

Microphone 104 may be any standard hand-held microphone, wireless or wired, that singer 101 may hold comfortably and may sing through. In this embodiment, shield 102 has a form that conforms generally about the head of singer 101 to provide a half-shell or edge-formed barrier that prevents airborne particles that the singer may eject while singing from advancing forward or angularly to the side. Shield 102 may be a completely transparent material for the purpose of visibility of the singer including likeness of the singer; however, it is not a requirement in order to practice the invention. In one embodiment, shield 102 may be opaque, frosted, bear a design, logo, message, and/or a special shape or form without departing from the spirit and scope of the present invention.

For the purposes of discussion, shield 102 is a transparent plastic or polymer shield. Shield 102 has a through opening (hole) provided through the front of the shield wall that provides a passage for a narrower end of a microphone inserted through the shield material on the side of singer 101 to seat microphone 104. A microphone seating collar 103 is provided in this embodiment for seating microphone 104 at an angular position generally analogous to a normal singing angle a microphone might assume when held by singer 101 or when attached to a microphone stand (not illustrated) directly in front of a singer like singer 101.

Microphone seating collar 103 may be attached to or otherwise formed to the shield material about the provided passage opening placed through the shield to accommodate the microphone. In this embodiment collar 103 may be fabricated from a polymer tubing material that has a rigid character or semi-rigid character. The inside diameter of collar 103 may taper downward in dimension to match a downward taper of the outside dimension of a standard hand-held microphone like microphone 104. The inside diameter of collar 103 is purposely held smaller than the outside dimension of microphone 104 where a microphone head 105 attaches to the microphone body such that the microphone cannot be passed through collar 103.

In this embodiment, singer 101 may hold microphone 104 with either or both hands while singing. In this embodiment, microphone 104 is connected to a microphone cord having a standard three-prong plug 106. Shield 102 is supported by microphone seating collar 103 as singer 101 holds the microphone with either or both hands. The lightweight material of the shield is not noticeable to singer 101 compared to the normal weight of the microphone.

Of importance is the vertical height of shield 102 wherein singer 101 may look over the shield at the audience such that her eyes are not hidden behind the shield that may reflect light even if it is transparent. The vertical height of the shield may extend several inches below where microphone head 105 is positioned in front of singer 101. In this way, forward particulates potentially ejected by the singer are prevented from being ejected with force beyond the frontal boundary of the shield.

Essentially, shield 102 is oriented off of the plane of the face of singer 101 to be generally parallel so that if the singer turns her head left or right when singing the shield remains positioned correctly. Singer 101 may change the angle of presentation of shield 102 by manipulating microphone 104 within the normal parameters for a singer holding a microphone.

Figure 2:
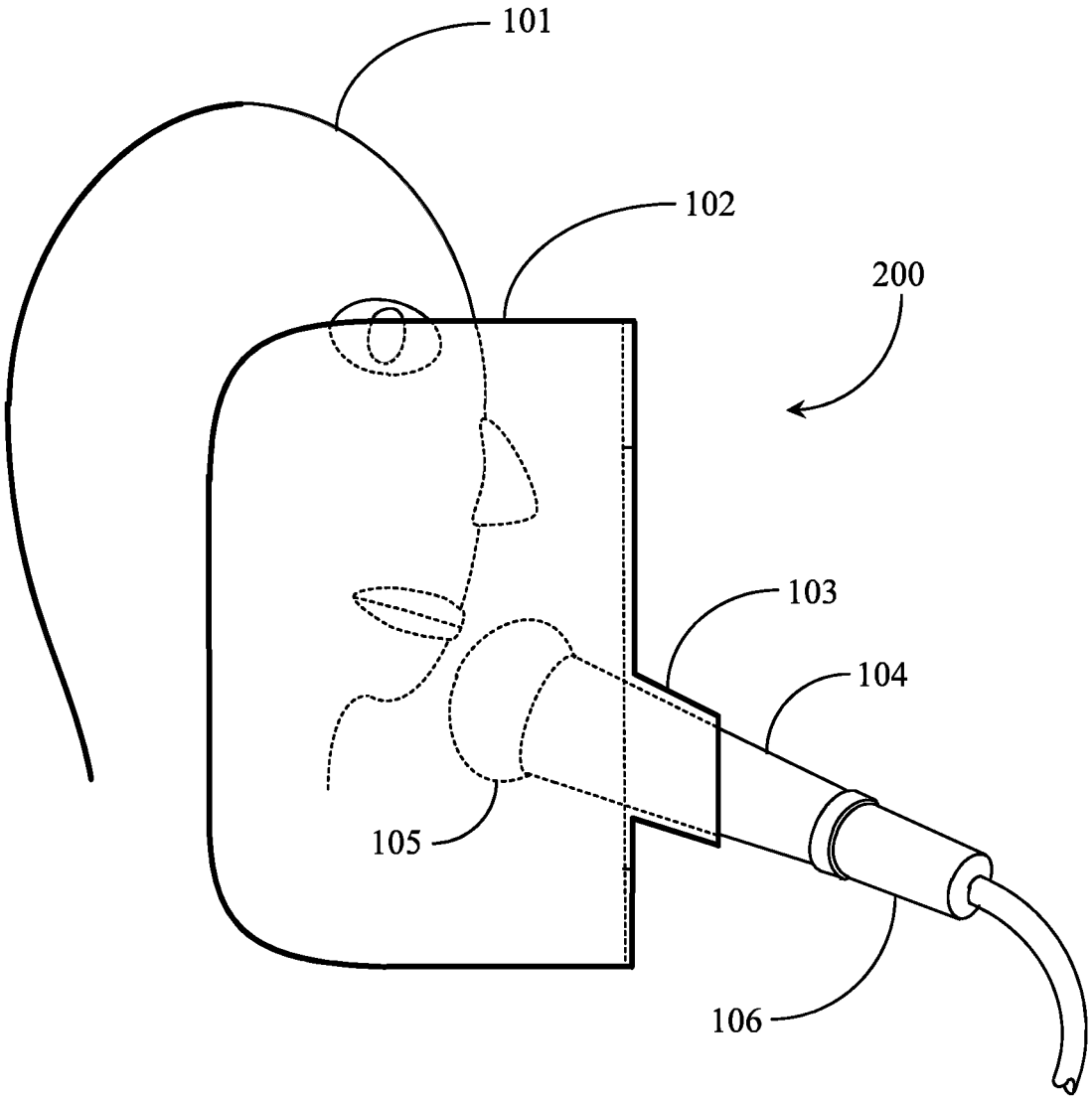
FIG. 2 is a side elevation view of the microphone shield and seated microphone of FIG. 1.

FIG. 2 is a side-elevation view 200 of the microphone shield and seated microphone of FIG. 1. Shield 102 as viewed from the right side of singer 101 in view 200 exhibits an angular relationship with microphone 104. When microphone head 105 is brought to the lips by singer 101, the angle of the microphone is most comfortable for the user at approximately 110 degrees or 20 degrees past ninety-degrees or perpendicular to the plane of the singer's face. This is not absolutely required of the present invention. Microphone seating collar 103 is contiguous with the material of shield 102 in this implementation and may be formed along with shield 102 in a plastic mold. In another embodiment, collar 103 may be a separate part that is attached or welded or glued to shield 102 without departing from the spirit and scope of the present invention.

In this view, the ends (near and far) of shield 102 extend back behind the plane of the face of singer 101 several inches to provide three-dimensional protection from particulate projection beyond the shield boundary. The wing portions of shield 102 may be bowed backward or folded sharply backward without affecting the performance of the shield.

Microphone 104 may be seated within seating collar 103 by unplugging (plug 106) the microphone 104 from a mic cord, or before attaching the mic cord, and inserting the tail or plug end of microphone 104 into collar 103 from the singer's side of shield 102. Microphone 104 is pushed through until the microphone is securely seated within the collar and can be pulled through no further. This secures the shield 102 onto microphone 104 and enables singer 101 to plug microphone 104 to a cable and place it on a microphone stand having a standard microphone clip that would secure the microphone at a similar angle that singer 101 may hold the microphone comfortably. The length of collar 103 may vary from one-half inch to one and one-half inches or with enough length to determine a secure surface grip footprint for the interface.

Shield 102 may be multifariously shaped into any desired form. For example, a dip may be provided at the top of the shield to reveal a singer's eyes, The wing portions of the shield that extend behind the plane of the singer's face may take the form of bird, butterfly wings, or any other preconceived shape or design. The performance of shield 102 is not dependent on shape and shape should not be considered a limitation of the invention.

Figure 3:
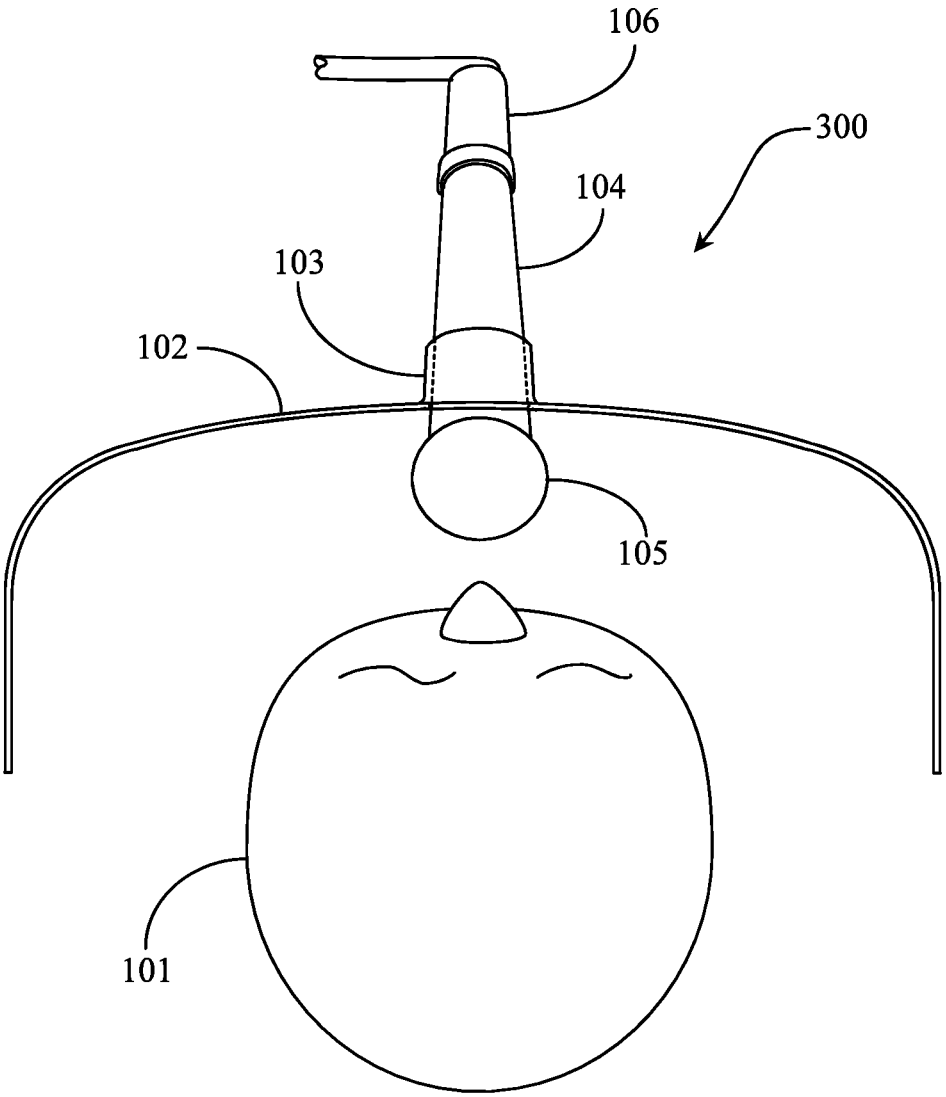
FIG. 3 is an overhead view of the microphone shield and seated microphone of FIG. 1.

FIG. 3 is an overhead view 300 of microphone shield 102 and seated microphone of FIG. 1. View 300 depicts microphone shield 102 in singing position supported by microphone 104 securely seated within microphone seating collar 103. The forward wall of shield 102 may be forward of the singer's face plane by three inches or so relative to the singer distancing her mouth from the microphone head 105. The free wing portions of shield 102 may extend back to the ear or just short of the ear of the singer on each side.

In this embodiment, microphone seating collar 103 is contiguously formed with shield 102 and may be the same material or another polymer material that may be molded to the shield material forming a contiguous bond that is airtight around the collar. In this embodiment, the forward wall of shield 102 has a bow, and the wing portions thereof bend back at a moderate radius. In other embodiments other forms might be produced such as a straight shield wall with side wing portions extending sharply backward form sharp or sharper corners.

In another embodiment shield 102 may be formed as a series of angled segments that generally follow the radius lines of the bowed shield discussed above. There are many possibilities for differing shape profiles for a shield. In one embodiment, a shield supported by microphone 104 may be about 10 inches across in the front having wing portions extending back five or six inches on either side of the shield. In this example, microphone 104 is attached to a microphone cord by a plug 106; however, in another embodiment, microphone 104 may be a wireless signal microphone that may be held by the singer placed back on a mic stand repeatedly during a typical performance.

Figure 4:
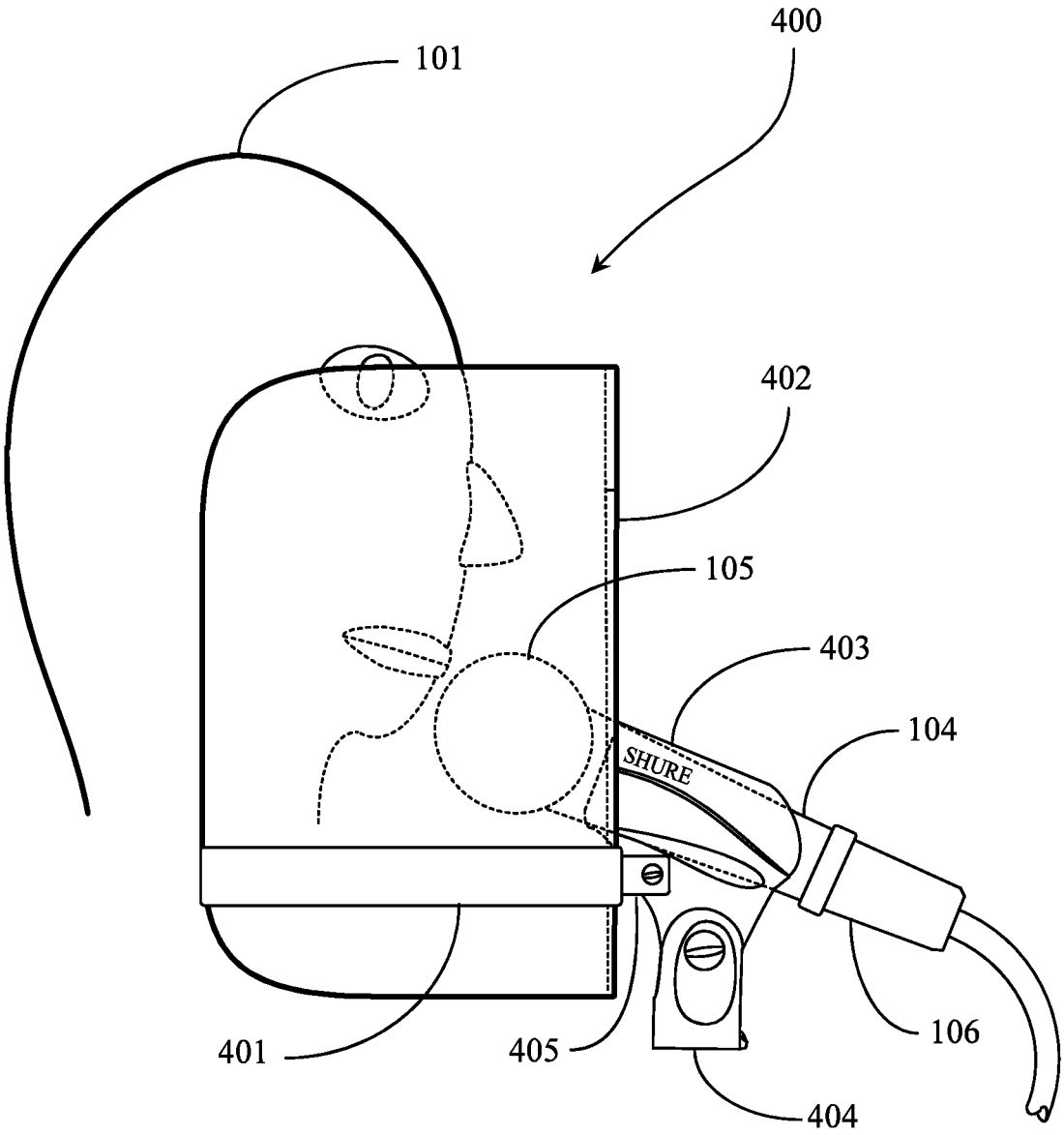
FIG. 4 is a side elevation view of a microphone shield and microphone seated according to another embodiment of the present invention.

FIG. 4 is a side elevation view 400 of a microphone shield with a microphone seated according to another embodiment of the present invention. View 400 depicts a microphone shield 402 having a passage opening for accepting a standard microphone clip 403 rather than utilizing a shorter microphone seating collar. Microphone clip 403 has a forward end that may be welded to or otherwise attached to the passage opening placed through the shield wall for the purpose. Microphone head 105 is inside the shield 402.

In one embodiment, microphone clip 403 is a SURE™ standard microphone clip that may be mounted to a microphone stand using cap 404 attached to clip 403. Cap 404 is adjustable relative to clip 403. Cap 403 may be threaded onto a microphone stand with shield 402 in place supported by the clip body. Microphone 104 sans plug 106 may be placed into microphone clip 403 as any standard microphone would be placed therein until the inside of the clip contacts the outside of the microphone.

In this embodiment, microphone clip 403 is held in position relative to shield 402 by a support band 401. Support band 401 may be fabricated of aluminum or another metal. In one embodiment, support band 401 may be a rigid plastic form that may be mounted over the forward surface wall of shield 102. Support band 401 extends laterally in this example from one lateral edge of the shield to the opposite edge of the shield though this extent of support band 401 is not required to practice the invention successfully.

Microphone clip 403 may be mounted on band 401 at a pair of forward-facing tabs 405 (one for each side of clip). Standard hardware such as a screw and washer may be used to secure clip 403 to band 401. In one embodiment, clip 403 is attached to band 401 but only extends through the forward-facing wall of shield 402 at an opening provided through the shield wall for the purpose. In a preferred embodiment, the shield material is closely dimensioned at the passage opening so that the interface has no appreciable gaps at the angle of presentation. In one embodiment a ring gasket (not illustrated) may be provided over clip 403 to interface against the leading edge of the shield wall around the passage.

Figure 5A:
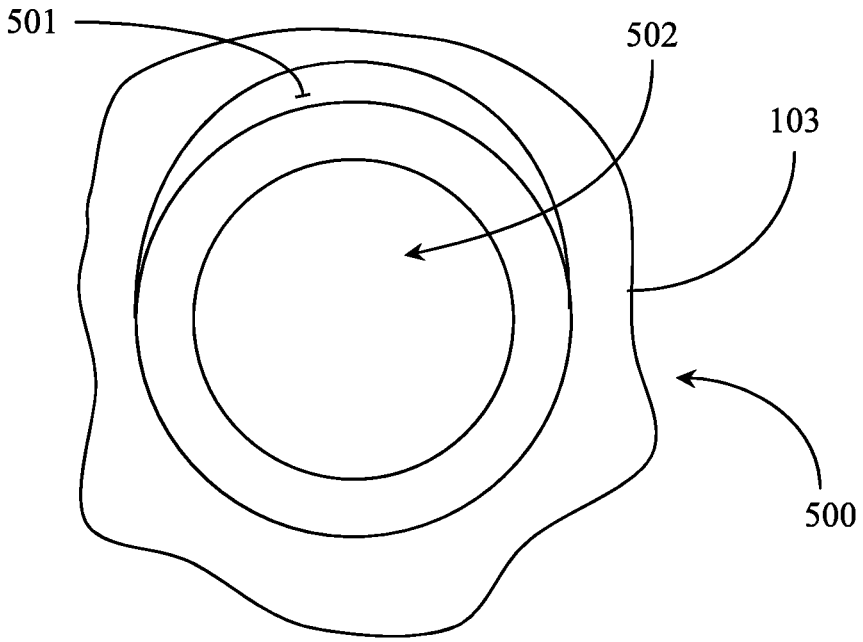
FIG. 5A is an enlarged elevation view of a microphone seating collar removable from and attachable to a microphone shield according to an embodiment of the invention.

FIG. 5A is an enlarged elevation view 500 of a microphone seating collar removable from and attachable to microphone shield 103 according to an embodiment of the invention. View 500 is enlarged to depict a portion of material form shield 103 of FIG. 1 where a passage opening has been created for a microphone seating collar 501. In this embodiment collar 501 is a more flexible attachment part that can be physically assembled to shield 102 at the passage opening. Collar 501 functions like a grommet material and may be fabricated of a resilient and durable silicon rubber.

Collar 501 is tubular and angles downward to seat a microphone at an angular relationship with the shield as detailed further above with respect to collar 103 of FIG. 1 and FIG. 2. The inside diameter 502 is held dimensionally to just larger than the outside diameter of the microphone below the microphone head as previously described. Seat 502 may be tapered at a same or similar angle than the microphone and securely abuts the microphone body flush all around the inside of the collar.

Figure 5B:
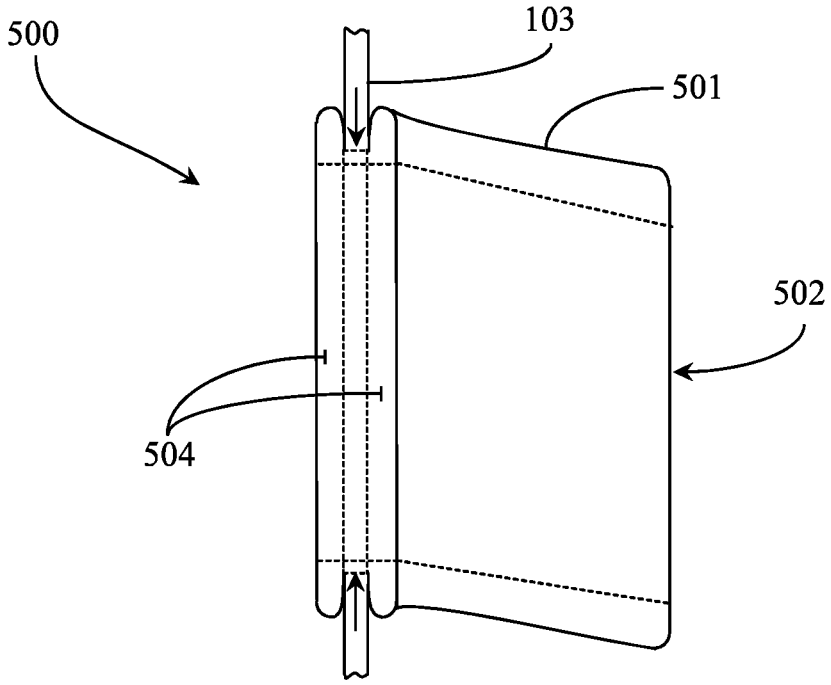
FIG. 5B is an enlarged side view of the microphone seating collar of FIG. 5A.

FIG. 5B is an enlarged side view of microphone seating collar 501 of FIG. 5A. Collar 501 functions like a grommet to seat a microphone. Grommet rings 504 are provided at the installation side of microphone seating collar 501. Grommet rings 504 are spaced closely together leaving a gap that is the same width or a smaller width than the thickness of the shield material of shield 103. Grommet rings 504 are larger in outside diameter than the passage opening provided through the shield material depicted herein by the opposing vertical arrows.

Seating collar 501 may be physically deformed or intentionally collapsed at the grommet end to install the leading grommet ring 504 through the shield opening sandwiching the shield material between grommet rings 504. Releasing the grommet ring 504 on the inside causes the grommet end to sandwich the material around the passage opening because due to the resilience of the material (regaining form). Collar 501 forms an airtight seal around the passage opening and provides the downward angled tube portion to seat the microphone. Opening 502 may grip the outside diameter of the microphone body of an inserted microphone at an inch, more or less, before the head piece of the microphone.

In some microphones a thumb switch is provided on the side of the microphone to turn the mic on or off. In one embodiment, a relief groove may be provided in the inside diameter wall of the collar to enable the microphone to be inserted down into the collar without obstructing the switch component. In one embodiment, the collar is intentionally shorter in length than the mic body from the switch to the head piece of the microphone enabling the singer to switch the microphone on and off without removing the shield. In this embodiment, the grommet collar 501 may be physically rotated clockwise or counterclockwise to change the direction of angle of the tubular portion seating the microphone. In another embodiment, different size grommet collars 501 may be replaced in shield 103 to provide for different size microphones to be used with shield 103.

Figure 6A:
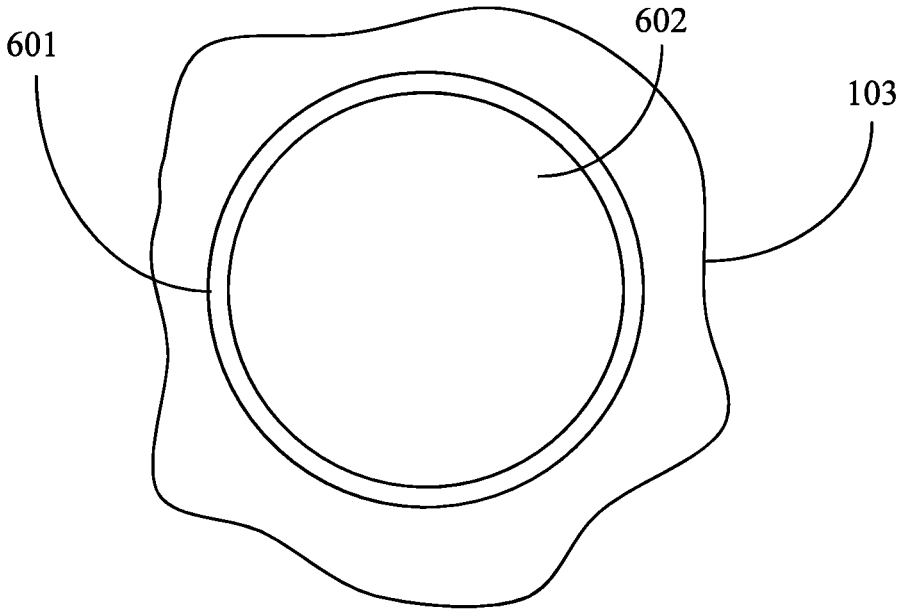
FIG. 6A is an enlarged elevation view of a microphone seating collar contiguous with the microphone shield material.

FIG. 6A is an enlarged elevation view 600 of a microphone seating collar contiguous with the microphone shield material. In this embodiment, shield 103 has a contiguous microphone seating collar 601 formed contiguously with the shield 103 by molding, heating, or any other forming process using a heated tool or jig. Microphone seating collar 601 is formed at a substantially right angle to the face shield plane and is comparatively shorter than other collars depicted above. Opening 602 is the passage through which the microphone may be inserted tail end first from the singer side of the shield as depicted in FIG. 1.

Figure 6B:
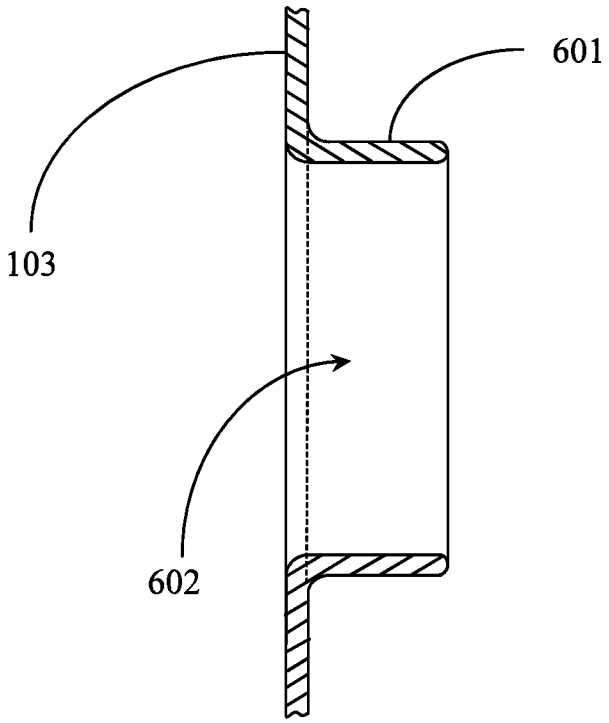
FIG. 6B is a section view of the microphone seating collar of FIG. 6A.

FIG. 6B is a section view of the microphone seating collar 601 of shield 103 of FIG. 6A. In this view, collar 601 extends orthogonally from the plane of the shield 103 three-quarters of an inch to approximately one and one-half inch. In this embodiment, collar 601 has no taper. The inside diameter of opening 602 is substantially uniform. A microphone having a uniform body may be inserted into collar 601, the microphone extending orthogonally from the shield 103 wall instead of diagonally therefrom. The microphone head may be larger, the same, or similar in diameter to opening 602 without departing from the spirit and scope of the invention. The inside diameter of collar 601 may be held to tolerance to the same or just larger than outside diameter of the microphone body for press fit or otherwise snug fit of the microphone and collar.

In one embodiment, a microphone shield 103 may be adapted to hold more than a single microphone linearly and spaced apart on a much longer shield 103 that may accommodate two or more backup singers using microphone stands. In this variation, the shield 103 may have backward extending wing portions for each singer, the singers and shield sections spaced appropriately, the shield 103 supported in position by the inserted microphones planted in microphone clips on microphone stands. In this embodiment, the shield 103 is not mobile but supported by the row of microphones (two or more).

In still another embodiment, microphone shields 103 may be used in studio settings to ensure musicians who might be facing one another do not project particulate past the shield 103 boundaries towards one another. It will be apparent to a person with skill in the art that the performance art microphone shield 103 of the present invention may be provided using some or all the elements described herein. The arrangement of elements and functionality thereof relative to the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A shield assembly for reducing forward projection of airborne particles ejected from a live performer comprising;

a planer transparent face shield having a length, a height, and a uniform thickness, the shield including at least one through opening;

an annular microphone collar having an overall length, an overall outside diameter, and an overall inside diameter, the microphone collar affixed to at the through opening, the microphone collar accepting a microphone or microphones placed therein;

wherein when the microphone is held in position by the performer, the shield covers the entirety of the performers mouth and nose.

2. The shield of claim 1, wherein the shield is a polymer sheet molded to or otherwise formed to a shape presenting a forward shield wall flanked on either side by substantially parallel rearward-extending wing portions.

3. The shield of claim 1, wherein the microphone collar extends forward and angularly downward from the forward face of the shield, the longitudinal axis of the microphone and the vertical axis of the shield forming an intersect angle larger than ninety-degrees.

4. The shield of claim 1, wherein the microphone collar extends forward and orthogonally from the forward face of the shield, the longitudinal axis of the microphone and the vertical axis of the shield forming an intersect angle of substantially ninety-degrees.

5. The shield of claim 1, wherein the microphone collar is fabricated of silicon rubber material and is affixed to the material form in the fashion of a grommet.

6. The shield of claim 1, wherein the microphone collar is materially contiguous with the shield.

7. The shield of claim 1, wherein the forward face of the shield is shaped on the top edge thereof to reveal the singer's eyes, the bottom edge extending several inches below the singer's mouth.

8. The shield of claim 1, wherein the microphone collar is a standard microphone clip attached to the shield.

9. The shield of claim 8, wherein the shield is mounted to a microphone stand via the microphone clip.

10. The shield of claim 1, wherein the inside diameter of the microphone collar tapers down from the shield to the free end thereof to match the existing taper of the outside diameter of the seated microphone.

11. The shield of claim 1, wherein the shield material is wholly or partially transparent.

12. The shield of claim 1, wherein the shield material is painted or marked with one or a combination of symbols, words, logos, or artwork.

13. The shield of claim 2, wherein the wing portions are shaped to emulate bird wings or butterfly wings.

14. The shield of claim 5, wherein the microphone collar has a grommet attachment end and presents at an angle to the forward face of the shield and wherein a singer may change the direction of the angle by turning the microphone collar clockwise or counterclockwise at the grommet interface.

15. The shield of claim 1, wherein there are two or more through openings equally spaced apart linearly in the shield to host a like number of microphone collars and four or more rearward extending wing portions to flank a like number of singers, and wherein the shield is supported by the row of equally spaced microphones clipped onto a like number of microphone stands.

* * * * *